United States Patent [19]

Miller

[11] 4,115,886

[45] Sep. 26, 1978

[54] FLUID MATTRESS WITH SQUARED GUSSET PANEL CONSTRUCTION

[76] Inventor: Craig Salvatore Miller, 7688 Calla Durango, Anaheim, Calif. 92803

[21] Appl. No.: 754,015

[22] Filed: Dec. 23, 1976

[51] Int. Cl.[2] ..... A47C 27/08

[52] U.S. Cl. ..... 5/365; 3/370

[58] Field of Search ..... 229/5.5; 5/365, 370, 5/371

[56] References Cited

U.S. PATENT DOCUMENTS

| | | | |
|---|---|---|---|
| 2,987,735 | 6/1961 | Nail | 5/365 |
| 3,778,852 | 12/1973 | Penn et al. | 5/371 |
| 3,825,172 | 7/1974 | Mollura | 229/5.5 |
| 3,918,110 | 11/1975 | Cantillo et al. | 5/371 |
| 3,925,835 | 12/1975 | Pennington et al. | 5/371 |

*Primary Examiner*—Casmir A. Nunberg
*Attorney, Agent, or Firm*—Richard L. Myers

[57] ABSTRACT

A fluid mattress is formed by a top sheet, a bottom sheet, and a gusset panel extending between the peripheral edges of the sheets. The mattress has square corners resulting from a preferred method of construction wherein a die is provided with a curved surface having a radius R1. Material to be joined in the corner of the mattress is provided with a radius of curvature R2 which is dependent upon the radius R1. In a preferred method step, the centers of curvature of the radii R1 and R2 are aligned and the material is folded in a manner to minimize the excess of material and the resulting flow of material during the formation of a heat seal.

13 Claims, 12 Drawing Figures

FLUID MATTRESS WITH SQUARED GUSSET PANEL CONSTRUCTION

BACKGROUND OF THE INVENTION

1. Field of the Invention

The present invention relates to fluid filled mattresses and more specifically to a gusset panel construction having square corners.

2. Discussion of the Prior Art

Typically, bed frames consist of a headboard, a footboard, and sideboards which define a generally rectangular chamber for receipt of a mattress. With this type of frame construction, it is particularly desirable to provide a mattress having the generally rectangular configuration of the chamber formed by the bed frame. Such a mattress would have generally square corners, with radii not exceeding three inches, which could substantially fill the rectangular chamber of the bed frame.

Perhaps the mattress characteristic of greatest concern, however, is that which maximizes the integrity of the fluid cavity. This is particularly important if the mattress is to be filled with a liquid. Under such conditions, a leak in the fluid cavity could permit escape of the liquid with consequent flooding resulting in damage to the bed frame and the adjacent room.

In a mattress construction of the prior art, a generally rectangular configuration is provided as disclosed by C. Mollura in U.S. Pat. No. 3,825,172 for Tubular Flexible Bag With Lap Welded Ends.

In this construction, a very large, single sheet of heat sealable vinyl is formed into the shape of a tube to provide the top, bottom, and two longitudinal sides of the mattress. Two end panels are provided and heat sealed to the ends of this tube. A specially formed die is provided with a cross-section having substantially the shape desired for the end of the mattress. At each end of the tube the marginal edges are folded over this die and one of the end panels is heat sealed to these marginal edges.

Although this mattress construction has a generally rectangular configuration, it has been most difficult to construct due to the very large size of the sheet forming the tube. In addition, the entire heat seal forming the four corners at each end of the mattress, has necessarily been formed in a single step. As a consequence, it has been very difficult to control the flow of material in this heat sealing step, and the fluid integrity of the mattress has suffered considerably resulting in many "leakers".

A preferred type of construction has been the gusset panel construction. In this type of mattress, upper and lower sheets have been provided to form the top and the bottom of the mattress. A gusset panel forming the sides and ends of the mattress has been connected between the peripheral edges of the top and bottom sheet. Such a construction is disclosed by Penn et al in U.S. Pat. No. 3,778,852.

This type of construction is much easier to manufacture but it has been particularly difficult to provide the mattress with square corners. As a consequence, the corners have been rounded to a radius such as 8 inches. To accommodate this configuration within the conventionally rectangular bed frame, it has been necessary to provide corner filling sections having large radii of curvature in order to support the rounded corners of the mattress.

Square corners in this gusset type mattress construction have been difficult to form since a large portion of the vinyl material has tended to gather at the corner when the heat seal is made. This excess of material creates an excess of vinyl flow which has tended to weaken the integrity of the mattress at the corners.

SUMMARY OF THE INVENTION

In accordance with the apparatus and method of the present invention, a mattress of the preferred gusset type construction is provided with generally square corners. This mattress, which has the simplicity of the gusset type construction, is shaped to fit into a rectangular bed frame without the necessity for any corner filling sections.

A special die makes it possible to align the material at the corner of the mattress in order to facilitate the formation of the pieces of material to be joined and carefully folding one of the pieces at the apex of each of the corners, the flow of material can be more easily controlled to provide a seal having a high degree of integrity.

These and other advantages of the present invention will become more apparent with a description of preferred embodiments and reference to the associated drawings.

DESCRIPTION OF PREFERRED EMBODIMENTS

Figure 1:
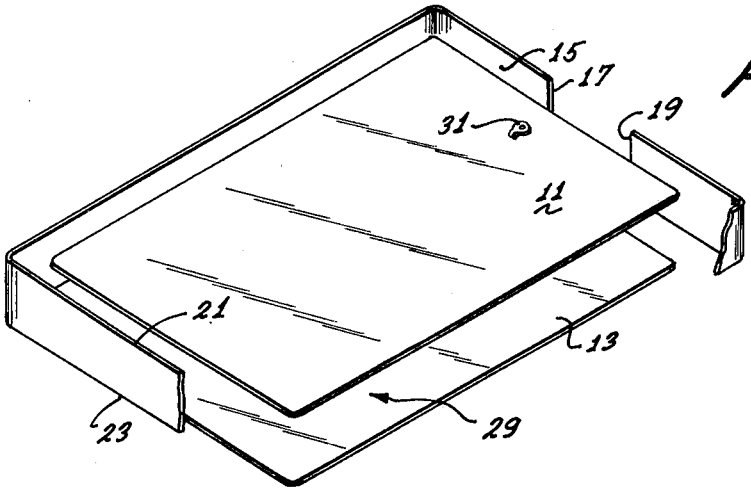
FIG. 1 is an expanded perspective view of the mattress construction of the present invention showing the square corners of the mattress formed by the top and bottom panels and a peripheral gusset panel.

The mattress construction of the present invention is of the preferred gusset type which includes a top panel 11, a bottom panel 13 and a gusset or side panel 15 connected between the peripheral edges of the panels 11 and 13. These panels can be formed of any vinyl plastic material having flexible, heat sealable characteristics. In a preferred embodiment, the material has a thickness of approximately 20 mils.

In the illustrated embodiment, the top and bottom panels 11 and 13 respectively are generally rectangular in shape and preferably have a generally planar configuration when the mattress is filled with a fluid such as water. The gusset panel 15 is substantially perpendicular to the panels 11 and 13 in this embodiment.

The gusset panel 15 may have the configuration of a parallelogram defined by end edges 17 and 19 and a pair of long side edges 21 and 23. In the final configuration of the embodiment, best illustrated in FIG. 12, marginal regions 25 at the periphery of the top panel 11 are connected to marginal regions along the edge 21 of the gusset panel 15. Similarly, marginal regions 27 around the periphery of the bottom panel 13 are connected to marginal regions along the edge 23 of the gusset panel 15. With the joining of the ends 17 and 19 of the panel 15, a fluid tight cavity 29 is formed by the panels 11, 13 and 15. A valve 31 can be provided in the panel 11 to provide means for filling the cavity 29 with a fluid such as water.

Figure 2:
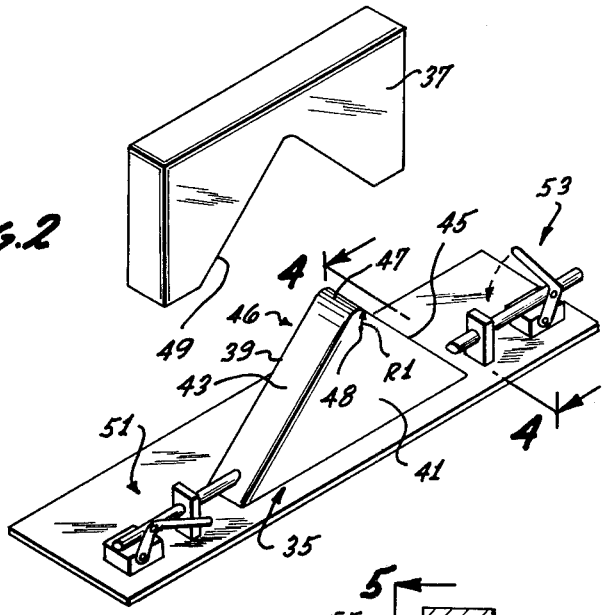
FIG. 2 is a perspective view of a die associated with the present invention which facilitates formation of the square corners of the mattress.

In a preferred method of construction, a die 33 is provided which has a base plate 35 and a hat 37 as illustrated in FIG. 2. The base plate 35 may have the configuration of the corner of a parallelepiped with a pair of upstanding side surfaces 39 and 41. A pair of surfaces 43 and 45 are upwardly facing and substantially perpendicular to the surfaces 39 and 41. A curved surface 46 having an apex 47 is disposed between these surfaces 43 and 45. The curved surface 46 in the illustrated embodiment has a radius of curvature R1 and a center of curvature 48. The radius of curvature R1 is not greater than three inches, preferably less than one inch, and approximately equal to three-eighths inch in the preferred embodiment. The hat 37 has a surface 49 which is configured to register with the surfaces 43, 45 and 46.

A pair of overcenter plungers 51 and 53 are provided for movement into pressure engagement with the surfaces 43 and 45 respectively of the base plate 35.

Figure 3:
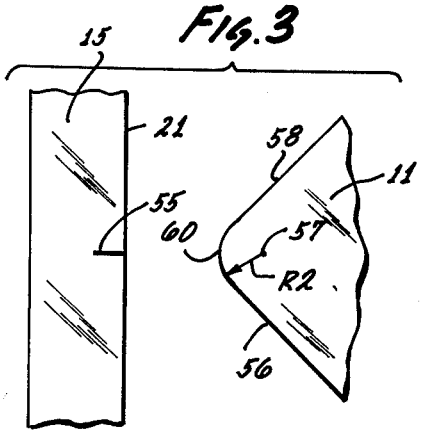
FIG. 3 is a plan view of a preferred shape of the two pieces of material which are joined to form one of the square corners of the mattress.

FIG. 3 illustrates the two pieces of vinyl material which can be used to form one of the corners of the mattress. The gusset panel 15 can be provided with an earmark 55 at the point along the edge 21 which is to coincide with the corner of the top panel 11. This corner of the top panel 11 is provided with a pair of generally straight edges 56 and 58 which are disposed on opposite sides of a curved edge 60. This curved edge 60 has a radius of curvature R2 and a center of curvature 57. It is of particular importance that this radius of curvature R2 be carefully cut in order to control the excess of material and the resulting flow of vinyl during the heat sealing of the mattress. The radius R2 is dependent upon the width of the surfaces 43, 45 which separate the surfaces 39 and 41, and is also dependent upon the width of the desired seam. More importantly, the radius R2 is dependend upon the radius R1 of the curved surface 46. In a preferred embodiment wherein the surfaces 39 and 41 are separated by approximately 1½ inches and the desired width of the seam is approximately one-half inch, the radius R2 is equal to the radius R1 plus approximately one inch. Thus, if the curved surface 46 has a radius R1 of ⅜ inches, it is preferred that the radius R2 be approximately 1⅜ inches.

Figure 4:
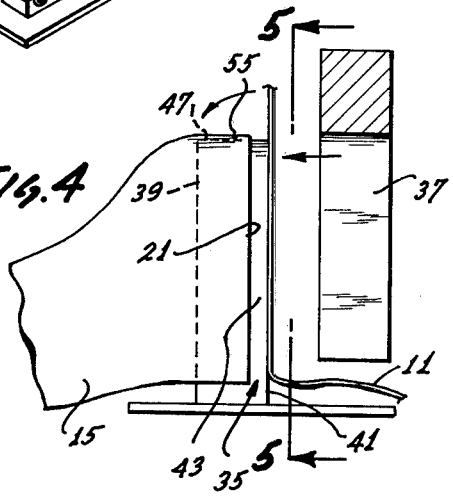
FIG. 4 is an end elevation view of the die taken along lines 4—4 of FIG. 2 and showing a preferred placement of the material on the die.

The initial steps for forming the corner seam are illustrated in FIG. 4. The gusset panel 15 can be folded over the surfaces 43 and 45 of the base plate 35 with the earmark 55 at the apex 47. The corner of the panel 11 can then be placed in surface contact with the surface 41 on the side of the base plate 35.

Figure 5:
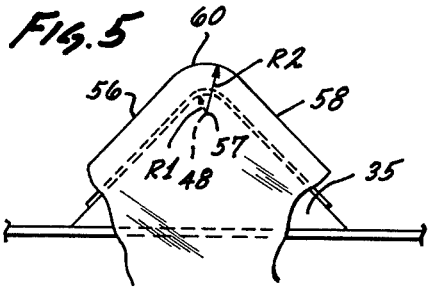
FIG. 5 is a side elevation view of the die taken along lines 5—5 of FIG. 4 and showing a preferred placement of the material on the die.

This placement of the panel 11 is of particular importance as illustrated in FIG. 5. In the preferred method of construction, the center of curvature 57 is placed in alignment with the center of curvature 48. This method is preferred since it ensures that the curved edge 60 of the panel 11 is concentric with the curved surface 46 of the base plate 35.

Figure 6:
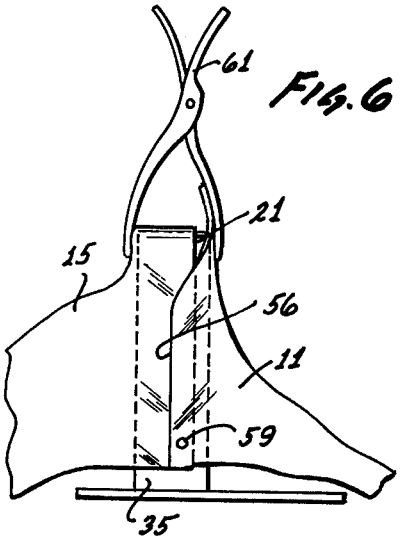
FIG. 6 is an end elevation view of the die showing the material clamped to the die prior to the heat sealing step.

The next step in the preferred method is to overlay the edge 21 of the panel 15 with the edges 56, 58 and 60 of the panel 11 as illustrated in FIG. 6. The overlying relationship can be maintained using the overcenter plungers 51 and 53 which can be brought into pressure contact with the panels 11 and 15 at a point illustrated by the dot 59. A clamp 61 can be used to maintain the panels 11 and 15 against the surfaces 39 and 41, respectively, of the base plate 35.

Figure 7:
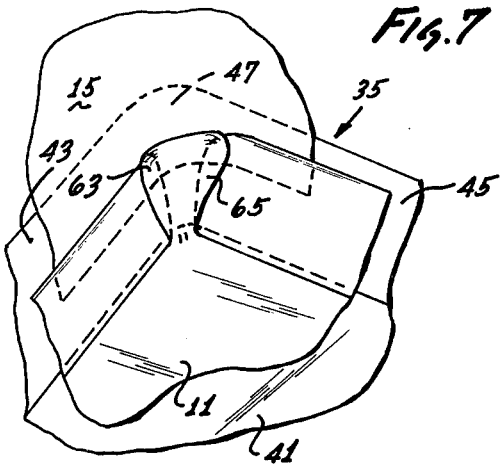
FIG. 7 is an enlarged fragmentary view of the die with the material folded in a preferred configuration prior to the heat sealing step.

As illustrated in the enlarged view of FIG. 7, the excess of material at the corner of the upper panel 11 can be gathered at the apex 47 to form a pair of overlapping ears 63 and 65, one on each side of the apex 47. The formation of these ears 63 and 65 can be facilitated by moving the hat generally perpendicular to the surface 41 of the base plate 35 as illustrated in FIG. 4. Once the ears 63 and 65 have been formed and the hat 37 has been positioned, the die 33 can be placed in an ultrasonic welding apparatus of the type commonly used for this purpose.

Figure 8:
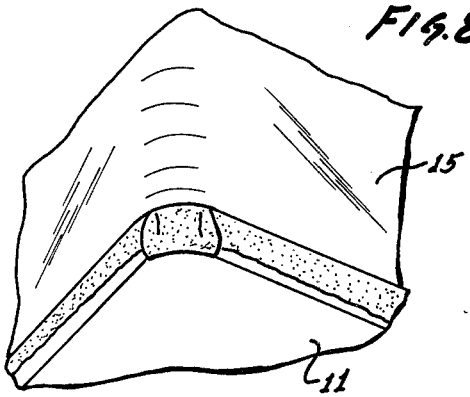
FIG. 8 is a perspective view of the mattress corner after the heat sealing step.

If the radius R2 is accurately cut and positioned, the gathered material at the apex 47 should extend generally to the edges of the panel 11. Forming the corners of the mattress in this manner minimizes the flow of excess material when the seam is ultimately formed as illustrated in FIG. 8.

Figure 9:
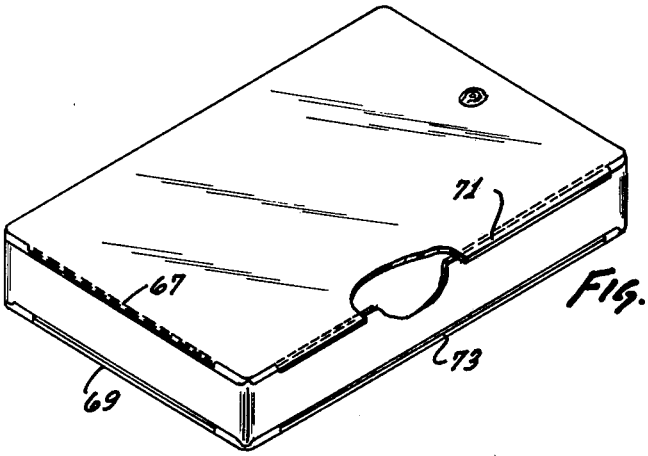
FIG. 9 is a perspective view of the mattress after the corners have been heat sealed and prior to the formation of the longitudinal heat seals between the corners.

The foregoing method for forming a corner of the mattress is repeated eight times in the preferred embodiment. A corner such as that described is formed at each of the four corners of each of the top and bottom panels 11 and 13. In order to complete the mattress, it is desirable to form longitudinal seams to interconnect these corner seams. There are eight such longitudinal seams; the four illustrated in FIG. 9 are designated by the reference numerals 67, 69, 71 and 73. These longitudinal seams 67–73 may be formed after all the corner seams have been completed but preferably they are formed after each associated pair of the corner seams are completed.

Figure 10:
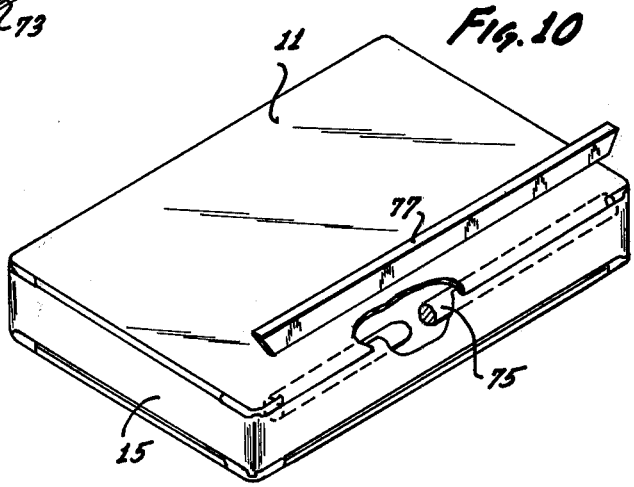
FIG. 10 is a perspective view of the mattress illustrating formation of the longitudinal heat seals.
Figure 11:
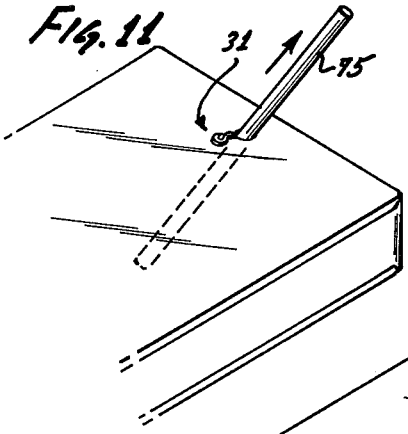
FIG. 11 is a partial perspective view of the mattress illustrating removal of a heat sink rod through the valve of the mattress.

The longitudinal seams 67–73 can be formed as illustrated in FIG. 10 by inserting a heat sink rod 75 between the top and bottom panels 11 and 13 respectively and using a die rod 77 for heat sealing the marginal regions 25 and 27 of the panels 11 and 13 respectively, to the marginal regions of the gusset panel 15. After the last of the longitudinal seams 67–73 have been completed, this heat sink rod 75 can be removed through the valve 31 as illustrated in FIG. 11.

Figure 12:
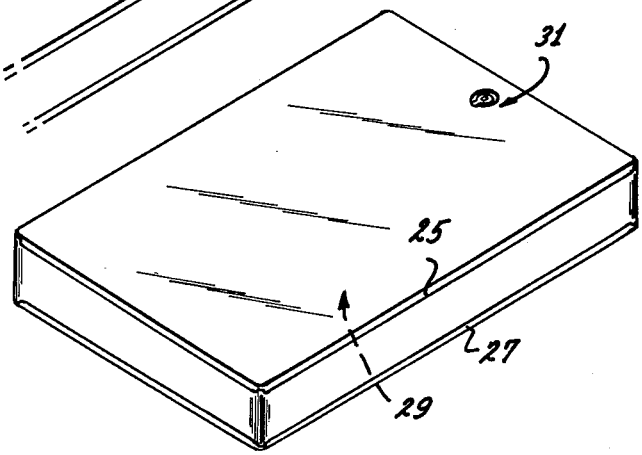
FIG. 12 is a full perspective view of the mattress of the present invention in its completed square cornered configuration.

The resulting construction illustrated in FIG. 12 provides a reliable water mattress with a high degree of integrity. The seams formed at the corner of the mattress in accordance with the foregoing method substantially reduce the amount of excess material flow and therefore permit the formation of square corners which are highly leak resistant. The resulting rectangular configuration of the mattress easily fills the rectangular mattress chamber formed by the conventional bed frame.

Although the invention has been described with reference to specific embodiments and methods of steps, it will be appreciated that other embodiments and method steps can be used so that the scope of the invention should be ascertained only with reference to the following claims.

I claim:

1. A mattress having characteristics for being filled with a liquid, comprising:

a first sheet of material having a first marginal portion extending around the periphery of the first sheet and having a generally planar configuration when the mattress is filled with the fluid;

a second sheet of material having a second marginal portion extending around the periphery of the second sheet and having a generally planar configuration when the mattress is filled with the fluid;

the first sheet having generally the shape of a rectangle, the rectangle having four substantially straight sides and four corners, a particular one of the corners having the configuration of a curve with a radius not greater than three inches;

a side panel extending around the periphery of the mattress and having a third marginal portion and a fourth marginal portion extending between first and second ends of the side panel;

means for connecting the third marginal portion of the side panel to the first marginal portion of the first sheet to form a first seal extending around the periphery of the mattress;

the side panel at the particular corner of the first sheet having the configuration of a curved surface when the mattress is filled with the fluid and the curved surface having a radius not greater than about 3 inches;

means for connecting the fourth marginal portion of the side panel to the second marginal portion of the second sheet to form a second seal extending around the periphery of the mattress;

means for connection the first end of the side panel to the second end of the side panel to form a fluid-tight cavity between the first sheet, the second sheet and the side panel; and means for providing access to the cavity to provide for the filling of the mattress with the fluid.

2. The fluid mattress set forth in claim 1 wherein the side panel is defined generally by at least two substantially planar portions and a substantially curved portion, the curved portion being disposed intermediate the two substantially planar portions and having a radius of curvature not greater than about three inches.

3. The fluid mattress recited in claim 1 wherein the mattress generally has the configuration of a parallelepiped.

4. The fluid mattress recited in claim 3 wherein the first and second seals are heat seals and the first seal has substantially the same shape as the second seal.

5. The fluid mattress set forth in claim 4 wherein the first sheet is substantially parallel to the second sheet and the side panel is substantially perpendicular to the first sheet.

6. A mattress having characteristics for being filled with a fluid comprising:

a first sheet of material having a first marginal portion extending at the periphery of the first sheet;

a second sheet of material having a second marginal portion extending at the periphery of the second sheet;

a gusset panel disposed around the periphery of the mattress and including a side section forming a side of the mattress, the side section of the gusset panel being disposed generally in a first plane and being defined by a third marginal portion and a fourth marginal portion;

the first sheet exclusive of the first marginal portion being disposed generally in a second plane transverse to the first plane, and the first marginal portion of the first sheet being disposed generally in the first plane of the side section of the gusset panel;

the second sheet exclusive of the second marginal portion being disposed generally in a third plane transverse to the first plane and the second marginal portion of the second sheet being disposed generally in the first plane of the side section of the gusset panel;

means for sealing the first sheet to the gusset panel to form a first seal extending around the periphery of the mattress, the first seal including portions joining the first marginal portion and the third marginal portion and being disposed generally in the first plane of the side section of the gusset panel;

means for sealing the second sheet to the gusset panel to form a second seal extending around the periphery of the mattress, the second seal including portions joining the second marginal portion and the fourth marginal portion and being disposed generally in the first plane of the side section of the gusset panel to form a fluid tight cavity defined by the first sheet, the second sheet and the gusset panel; and means for providing access to the cavity to facilitate the filling of the cavity with the fluid.

7. The mattress recited in claim 6 wherein the first plane of the gusset panel is substantially perpendicular to the second plane of the first sheet and the third plane of the second sheet.

8. The mattress recited in claim 6 wherein the side section of the gusset panel is a first side section and the gusset panel includes a second side section disposed adjacent the first side section and connected to the first side section along a surface of curvature having a radius less than about three inches.

9. The mattress recited in claim 8 wherein the second side section is disposed generally in a fourth plane and the first plane of the first side section is generally perpendicular to the fourth plane of the second side section.

10. The mattress recited in claim 6 wherein the gusset panel generally has the configuration of parallelogram.

11. The mattress set forth in claim 6 wherein the first seal and the second seal are heat seals and the first seal has substantially the same shape as the second seal.

12. The mattress recited in claim 6 wherein the first seal and the second seal are formed in the configuration of lap seams.

13. The fluid mattress recited in claim 1 wherein the first seal and the second seal are formed in the configuration of lap seams.

* * * * *